US008657344B2

(12) United States Patent
Glazik et al.

(10) Patent No.: US 8,657,344 B2
(45) Date of Patent: Feb. 25, 2014

(54) ADJUSTABLE ASSEMBLY FOR A DRAIN INLET

(75) Inventors: Gary B. Glazik, Paxton, IL (US); Steven G. Glazik, Paxton, IL (US)

(73) Assignee: Plastic Designs, Inc., Paxton, IL (US)

( * ) Notice: Subject to any disclaimer, the term of this patent is extended or adjusted under 35 U.S.C. 154(b) by 122 days.

(21) Appl. No.: 13/220,144

(22) Filed: Aug. 29, 2011

(65) Prior Publication Data

US 2013/0048121 A1 Feb. 28, 2013

(51) Int. Cl.
*F16L 15/02* (2006.01)

(52) U.S. Cl.
USPC ..... 285/302; 285/419

(58) Field of Classification Search
USPC ..... 285/298, 302, 303, 903, 419, 56; 138/166, 155; 210/163, 164, 166, 210/170.07; 239/280.5, 281, 200, 201
See application file for complete search history.

(56) References Cited

U.S. PATENT DOCUMENTS

| | | | | | |
|---|---|---|---|---|---|
| 368,372 | A | * | 8/1887 | Bingham | 285/298 |
| 1,123,705 | A | * | 1/1915 | Dehn | 285/298 |
| 1,301,244 | A | * | 4/1919 | Ford | 285/32 |
| 1,457,637 | A | * | 6/1923 | Sievers | 210/163 |
| 1,792,345 | A | * | 2/1931 | Williams | 210/164 |
| 1,805,816 | A | * | 5/1931 | Fleming | 210/165 |
| 1,833,040 | A | * | 11/1931 | Rader | 285/302 |
| 2,046,330 | A | * | 7/1936 | Leoffert | 285/302 |
| 2,968,440 | A | * | 1/1961 | Cone | 285/302 |
| 3,281,869 | A | * | 11/1966 | Schweigaard-Olsen et al. | 210/166 |
| 3,317,144 | A | * | 5/1967 | Muschett | 285/302 |
| 3,529,671 | A | * | 9/1970 | Adams, Jr. | 285/302 |
| 4,083,410 | A | * | 4/1978 | Anderson | 285/302 |
| 4,108,202 | A | * | 8/1978 | Schoepe | 285/303 |
| 4,182,364 | A | * | 1/1980 | Gilbert et al. | 285/303 |
| 4,274,592 | A | * | 6/1981 | Westhusin | 239/200 |
| 4,286,808 | A | * | 9/1981 | Fouss et al. | 285/903 |
| 4,463,460 | A | * | 8/1984 | Arnold et al. | 285/298 |
| 4,827,539 | A | * | 5/1989 | Kiziah | 285/303 |
| 4,854,665 | A | * | 8/1989 | Gagnon | 285/903 |
| 5,560,163 | A | * | 10/1996 | Carlton | 285/903 |
| 6,226,937 | B1 | * | 5/2001 | Carlton | 285/903 |
| 7,108,783 | B2 | * | 9/2006 | Glazik | 210/163 |
| 7,303,146 | B2 | * | 12/2007 | Swingley | 239/201 |
| 8,246,082 | B2 | * | 8/2012 | Stewart et al. | 285/302 |
| 8,262,308 | B2 | * | 9/2012 | Peng | 285/419 |

* cited by examiner

*Primary Examiner* — David E Bochna
(74) *Attorney, Agent, or Firm* — Cook Alex Ltd.

(57) ABSTRACT

An adjustable coupling assembly and drain inlet combination for adjusting the height of the drain inlet for draining a fluid from an area is disclosed. The assembly includes a first tubular cylinder having a first end which is constructed to be attached to the inlet of drain tile, and a second tubular cylinder having a first end which is constructed to be attached to the discharge of the drain inlet. One of the tubular cylinders has an end which is constructed to extend into the other tubular cylinder. A spiral groove on one of the tubular cylinders extends over a substantial portion of the length of that cylinder, and at least one projection is positioned on the other tubular cylinder and is positionable to extend into the spiral groove whereby when one of the tubular cylinders is rotated relative to the other tubular cylinder, the projection moves along the spiral groove, to adjust the total combined length of the first and second tubular cylinders and the height of the drain inlet. The drain inlet is attached to the upper tubular cylinder.

19 Claims, 3 Drawing Sheets

ADJUSTABLE ASSEMBLY FOR A DRAIN INLET

BACKGROUND AND SUMMARY OF THE INVENTION

The present invention is directed to an adjustable assembly for adjusting the height of a drain inlet for draining a fluid from an area.

It is frequently desirable to drain fluids, such as standing water from areas in which it accumulates for example during wet weather in the spring or during periods of flood. For example, it is desirable to drain the water from low spots or terraces in agricultural fields to improve the crops and/or the soil when drained.

In the past, such drainage has been accomplished by way of drain tile which is buried beneath the surface of the soil and upstanding inlets which are spaced periodically along the length of the tile and which open above the soil surface and into the area where the water has accumulated to drain the area through the buried drain tile. In such systems some form of grate or screen is usually positioned as a drain inlet at the opening to the upstanding inlet on the drain tile in order to prevent debris which may be in the water from flowing through the inlet and into the drain tile where it can rapidly clog the drain tile and prevent further drainage.

Various screen or grate devices have been employed in the past for this purpose. One such drain inlet is described in U.S. Pat. No. 7,108,783.

In a typical drain assembly a tubular coupling cylinder is positioned to extend into an upwardly facing opening on the inlet to the drain tile. The length of that coupling cylinder is then adjusted by cutting at a desired location along its length so that the upper end of the coupling cylinder extends just above the level of the soil. The bottom discharge end of the drain inlet, for example as shown in the aforementioned patent, is then inserted into the open top end of the cut to length coupling cylinder. The respective tubular coupling cylinders at each drain location are typically customized in length by cutting because in most cases the distance between the drain tile inlet and the soil surface can vary considerably from one location in the field to another.

The adjustable assembly of the present invention overcomes the cumbersome need to manipulate, calculate and cut the individual coupling cylinders to differing and correct lengths during installation. In the present invention, the length of the coupling cylinder can be easily and rapidly adjusted by simply screwing one of its parts into another part to easily, rapidly and accurately adjust the overall length of the coupling cylinder to its desired length.

In one principal aspect of the present invention, an adjustable coupling assembly for adjusting the height of a drain inlet for draining a fluid from an area comprises a first tubular cylinder having a first end which is constructed to be attached to the inlet of a drain tile, and a second tubular cylinder having a first end which is constructed to be attached to the discharge of the drain inlet. One of the tubular cylinders has an end which is constructed to extend into the other tubular cylinder. A spiral groove is on one of the tubular cylinders and extends over a substantial portion of the length of that tubular cylinder. At least one projection is on the other tubular cylinder and is positionable to extend into the spiral groove, whereby when one of the tubular cylinders is rotated relative to the other tubular cylinder, the projection moves along the spiral groove to adjust the total combined length of the first and second tubular cylinders and the height of the drain inlet.

In another principal aspect of the present invention, the first tubular cylinder has a second end which extends into a second end of the second tubular cylinder.

In still another principal aspect of the present invention, the projection is on the first tubular cylinder and the spiral groove is on the second tubular cylinder.

In still another principal aspect of the present invention, a plurality of projections are spaced from each other around the circumference of the tubular cylinder.

In still another principal aspect of the present invention, the projections are spaced from each other on the first tubular cylinder.

In still another principal aspect of the present invention, openings extend through the wall of the first tubular cylinder.

In still another principal aspect of the present invention, openings extend through the wall of the second tubular cylinder.

In still another principal aspect of the present invention, the openings which extend through the wall of the second tubular cylinder are slots between flights of the spiral groove.

In still another principal aspect of the present invention, at least one of the tubular cylinders comprises two portions which are semicircular in cross section, and the two portions are attached together to form the tubular cylinder.

In still another principal aspect of the present invention, each of the portions includes fasteners along their longitudinal edges, and the fasteners on one portion attach to the fasteners on the other portion to attach the portions together to form the tubular cylinder.

In still another principal aspect of the present invention, the fasteners along one longitudinal edge of a portion are projecting tabs and the fasteners along the other longitudinal edge are grooves, and wherein the tabs of one of the portions frictionally engage into the grooves of the other portion to attach the portions together.

In still another principal aspect of the present invention, both of the tubular cylinders each comprise two portions.

In still another principal aspect of the present invention, the assembly includes the drain inlet which is attached to the first end of the second tubular cylinder.

In still another principal aspect of the present invention, an adjustable coupling assembly for adjustably spanning the distance between spaced but adjacent ends of two fluid conveying conduits comprises a first tubular cylinder which has a first end which is constructed to extend into the end of one of the conduits, and a second tubular cylinder which has a first end which is constructed to extend into the end of the other conduit. One of the tubular cylinders has an end which is constructed to extend into the other tubular cylinder. A spiral groove on one tubular cylinder extends over a substantial portion of the length of that tubular cylinder, and at least one projection on the other tubular cylinder is positionable to extend into the spiral groove, whereby when one tubular cylinder is rotated relative to the other tubular cylinder, the projection moves along the spiral groove to adjust the total combined length of the first and second tubular cylinders.

In still another principal aspect of the present invention, a plurality of the projections are spaced from each other around the circumference of the tubular cylinder.

These and other objects, features and advantages of the present invention will be more clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENT

Figure 1:
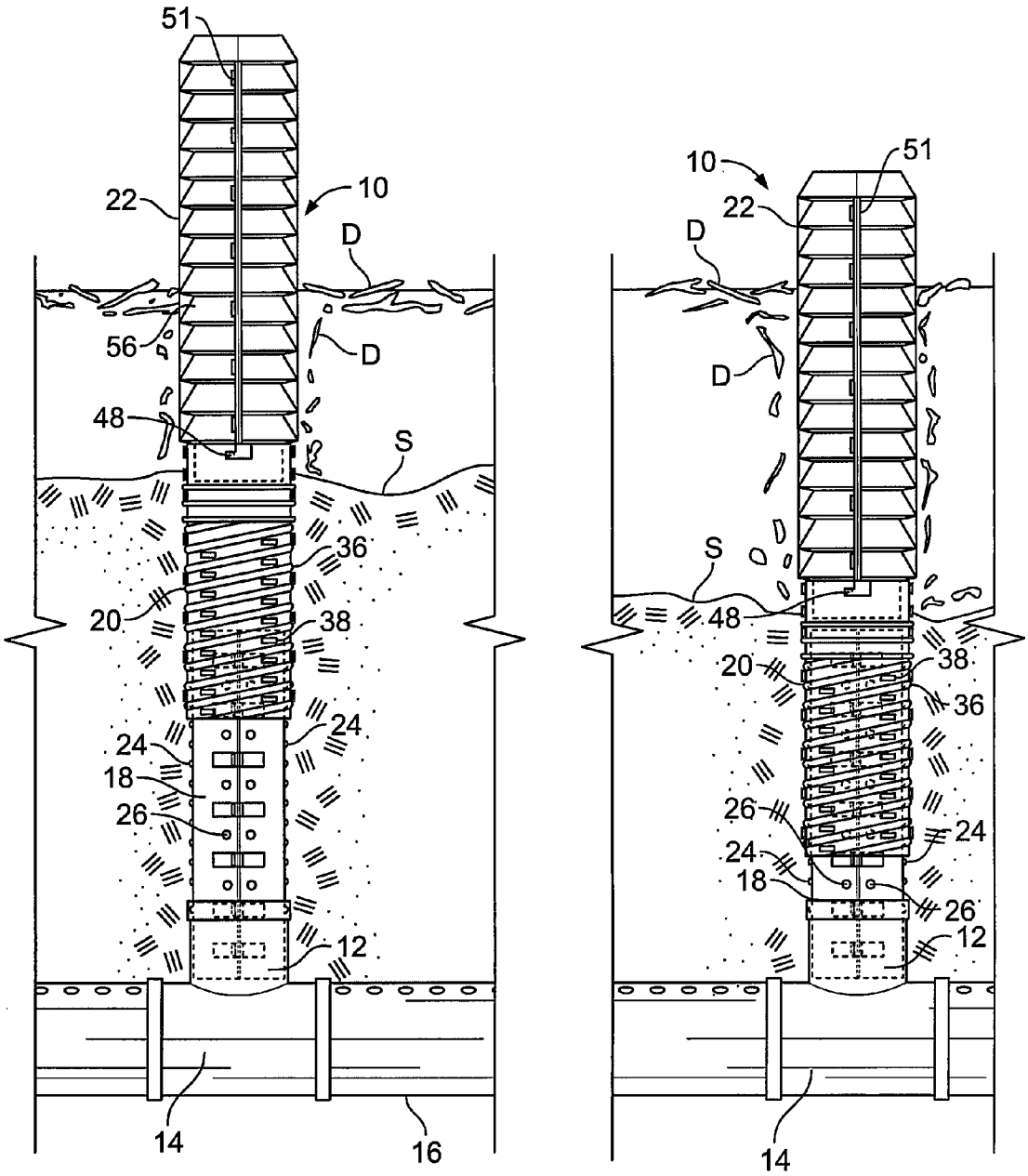
FIG. 1 is an elevation view of a preferred embodiment of the adjustable coupling assembly and drain inlet of the present invention showing it positioned in the upstanding inlet to a drain tile in the soil beneath the pond of water to be drained.

With particular reference to the drawings, a preferred embodiment of adjustable coupling assembly and drain inlet 10 of the present invention is shown mounted to the upstanding inlet 12 of the coupling 14 in a drain tile 16 system. The coupling and drain inlet assembly 10 preferably comprises a first tubular cylinder 18, a second tubular cylinder 20 and a drain inlet 22. The drain inlet 22 is shown in the drawings as cylindrical. However, it may take different forms or shapes as desired, such as the generally frustconical drain inlet as shown in U.S. Pat. No. 7,108,783.

Figure 2:
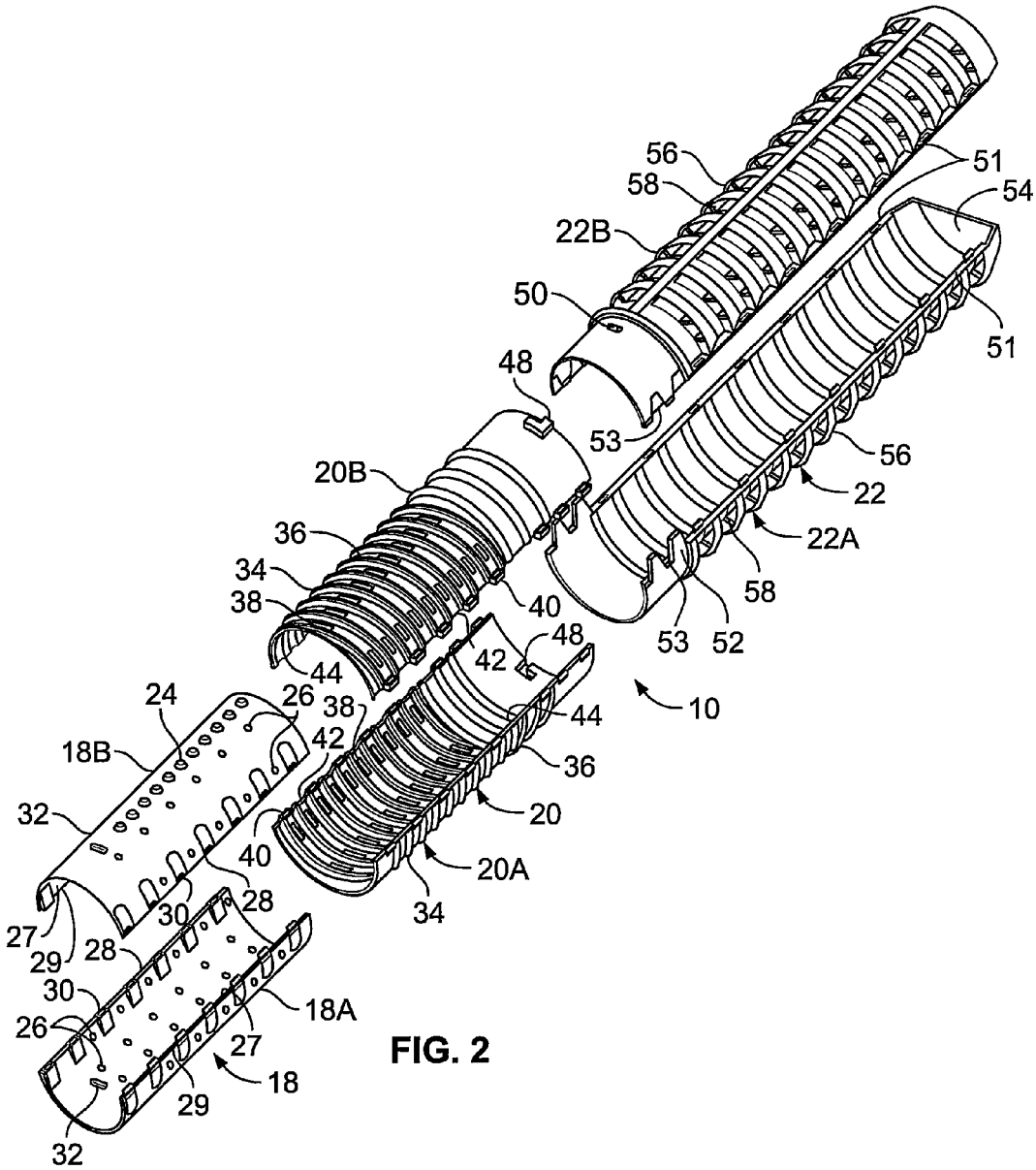
FIG. 2 is an exploded view of the adjustable coupling assembly and drain inlet of the preferred embodiment of the present invention.
Figure 3:
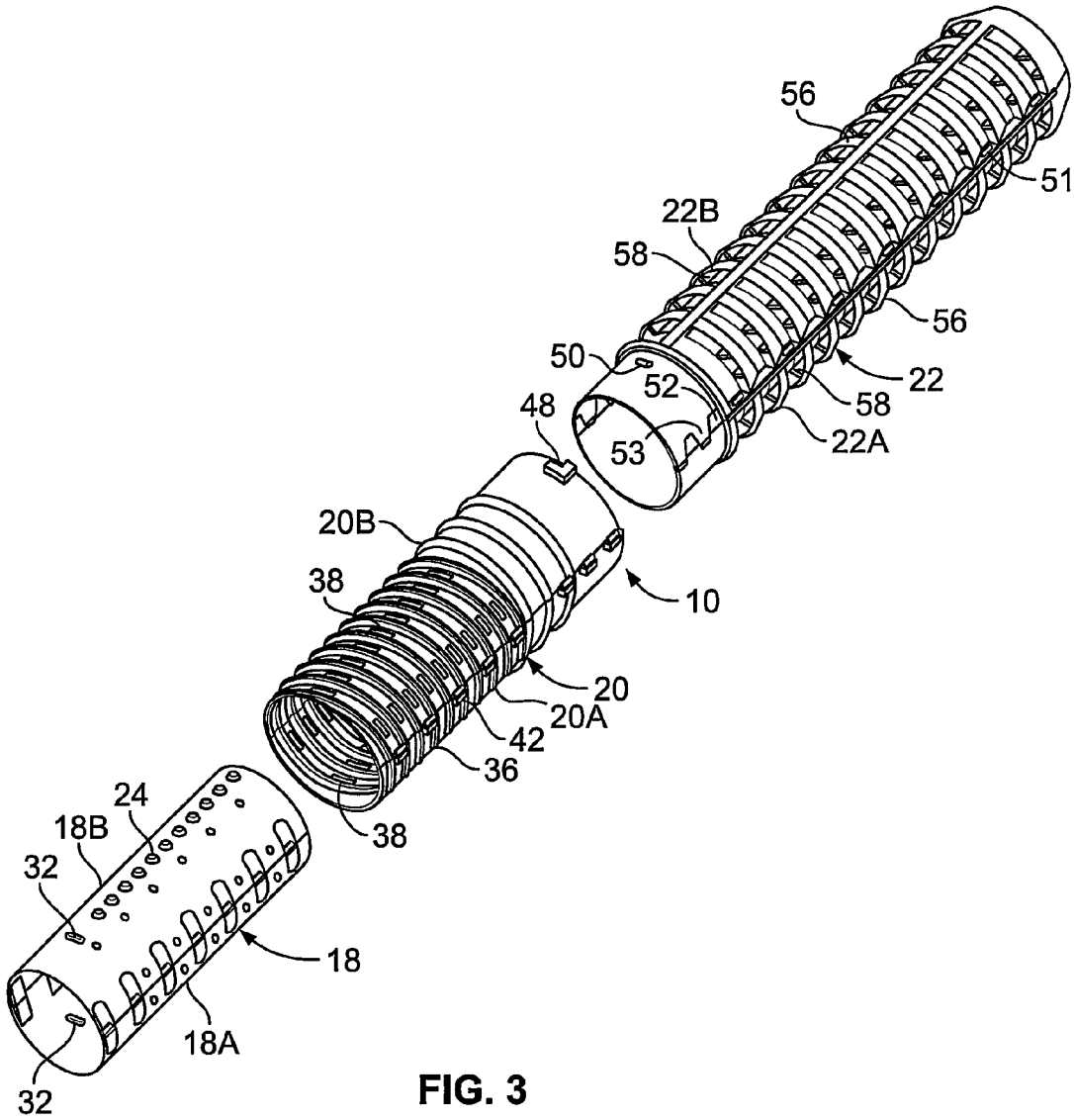
FIG. 3 is an exploded but partially assembled view of the adjustable coupling assembly and drain inlet of the preferred embodiment of the present invention.

The first tubular cylinder 18 is preferably formed of two portions 18A and 18B which are substantially semicircular in cross section, as best seen in FIGS. 2 and 3. Each of the portions 18A and 18B include projections 24 spaced along their length. The portions 18A and 18B also include openings 26 through their walls to permit drainage of water from the soil to the interior of the first tubular cylinder 18 where the water will then flow through the drain tile inlet 12 to the drain tile 14. One longitudinal edge 27 of the portions 18A and 18B is preferably formed to have projecting tabs 29, and the other longitudinal edge 28 is formed to have complimentary grooves 30 so that when the portions 18A and 18B are brought together, the tabs 29 frictionally enter the grooves 30 to frictionally hold the portions 18A and 18B together.

In addition, the first tubular cylinder 18 also preferably has a projection 32 on its surface to lock into a groove (not shown) in the upstanding drain tile inlet 12 to lock the first tubular cylinder 18 into that inlet 12 in a bayonet fashion.

The second tubular cylinder 20 is also preferably formed of two portions 20A and 20B, as best seen in FIGS. 2 and 3. Each of the portions 20A and 20B has a semi-spiral groove 34 formed on their walls so that when the portions 20A and 20B are combined to form the second tubular cylinder 20, the semi-spiral grooves combine to form a continuous spiral groove 36 which extends over a substantial portion of the length of the second tubular cylinder 20.

Openings preferably in the form of slots 38 also extend through the walls of the portions 20A and 20B between the flights of the spiral groove 36 to permit drainage of water from the soil into the interior of the coupling assembly and the drain tile inlet 12 and into the drain tile 14. It will be appreciated that even though a pond of water may not be present at the surface of the soil, there still may be considerable water in the soil itself which it would be desirable to drain through the drain tile 14. The openings 26 in the first tubular cylinder 18 and the slots 38 in the second tubular cylinder 20 facilitate such drainage.

As previously described with respect to the portions 18A and 18B of the first tubular cylinder 18, the portions 20A and 20B of the second tubular cylinder 20 also preferably include tabs 40 which extend along one longitudinal edge 42 of the portions 20A and 20B, and grooves 44 which extend along the other longitudinal edge 46 of the portions 20A and 20B. As previously described, when the portions 20A and 20B are combined, the tabs 40 frictionally engage into the grooves 44 on the other portion to couple the portions together to form the second tubular cylinder 20.

In addition, the upper end of the portions 20A and 20B also preferably include a slot 48 which receives a projection 50 on the bottom of the drain inlet 22 to lock the drain inlet to the top of the second tubular cylinder 20 when the drain inlet 22 is mounted thereto.

The drain inlet 22 as shown in the drawings comprises an elongate tubular cylindrical structure. However, as previously stated, it may take other geometric forms, for example as shown in U.S. Pat. No. 7,108,783. The drain inlet 22 as shown in the drawings also preferably comprises two portions 22A and 22B which are semi-circular in cross section. The portions 22A and 22B are preferably riveted together over their lengths along longitudinally extending ribs 51 extending along their lengths to form the cylindrical drain inlet 22. Each of the portions of 22A and 22B may also be formed with tabs 52 and grooves 53 which interfit with each other to couple the lower end of the drain inlet portions 22A and 22B together. As best seen in FIG. 2, the upper ends of the portions 22A and 22B are preferably formed with a wall 54 so that when the portions 22A and 22B are put together to form the drain inlet 22, the top of the drain inlet 22 will be closed.

The drain inlet 22 also comprises a plurality of annular upwardly and inwardly sloping walls 56 which form annular, downward facing slotted openings 58 between the top of each wall and the bottom of the next upper wall to permit water to flow into the interior of the drain inlet, but discourage the passage of debris D which may be in the water from flowing into the drain inlet, the coupling assembly, drain tile inlet 12 and drain tile 16 as described in U.S. Pat. No. 7,108,783.

Each or all of the first tubular cylinder 18, second tubular cylinder 20 and/or drain inlet 22 are preferably molded from a suitable polymer, such as a polyolefin. However, it will be appreciated that each of these components may be formed by known procedures other than molding and of other suitable polymeric materials.

Although it is believed from the foregoing description that the assembly, installation and operation of the adjustable coupling and drain inlet assembly 10 of the present invention will be appreciated by those skilled in the art, a brief description of same follows.

The respective portions 18A and 18B of the first tubular cylinder 18, the respective portions 20A and 20B of the second tubular cylinder 20 and the portions 22A and 22B of the drain inlet 22 are combined as previously described to from the complete cylinders 18, 20 and 22.

The lower end of the first tubular cylinder 18 is then inserted into the upstanding inlet 12 on the previously installed drain tile 14 and twisted so that its projection 32 locks the lower end of the first tubular cylinder 18 into a complementary bayonet style slot (not shown) in the upstanding inlet 12.

The second tubular cylinder 20 is then placed on the upper end of the first tubular cylinder 18 so that the top projection 24 on the first tubular cylinder 18 is engaged in the bottom of the spiral groove 36 of the second tubular cylinder 20. Once engaged, the second tubular cylinder 20 is rotated so that its spiral groove 36 progressively threads down onto the projections 24 on the first tubular cylinder 18 until the combined length of the first and second tubular cylinders is such that the upper end of the second tubular cylinder 20 is at a height that it will just clear the level S of the soil which is to be filled in about the combined adjusted length of the first tubular cylinder 18 and second tubular cylinder 20.

After the soil is filled in as desired about these cylinders and as shown in FIG. 1, to complete the assembly the drain inlet 22 is then mounted to the top end of the second tubular cylinder 20 as seen in FIG. 1 by rotating the drain inlet 22 to lock its projection 50 into the slot 48 at the top of the second tubular cylinder 20.

By way of example only and not as a limitation to the invention, the first tubular cylinder 18 and second tubular cylinder 20 may each be approximately 22 inches long and when combined their maximum total combined length may be 41 inches. However, when adjusted to their shortest total adjusted length, they may have a total combined length of only about 27 inches.

It will be appreciated that although in the preferred embodiment as previously described, the portions 18A and 18B and portions 20A and 20B are coupled together by frictional engagement between the tabs 29, 40 and grooves 30, 44 they may also be coupled by adhesive or by screws or rivets.

It should also be appreciated that although the adjustable coupling assembly of the present invention has been described as adjustably coupling a drain tile inlet to a drain inlet, it could also be employed to couple spaced but adjacent ends of two fluid conveying conduits, such as two sections of the drain tile 16 by spanning the distance between them. In such application, the adjustable coupling assembly would be deployed generally horizontally between the two spaced conduit ends rather than vertically as it would be where it functions to adjust the height of the drain inlet 22 as previously described.

It will also be understood that the preferred embodiment of the present invention which has been described is merely illustrative of the principals of the present invention. Numerous modifications may be made by those skilled in the art without departing from the true spirit and scope of the invention.

The invention claimed is:

1. An adjustable coupling assembly for adjusting the height of a drain inlet for draining a fluid from an area, the assembly comprising:

a first elongate tubular cylinder having a first end which is constructed to be attached to the inlet of a drain tile;

a second elongate tubular cylinder having a first end which is constructed to be attached to the discharge of the drain inlet;

said first tubular cylinder having an end which is constructed to extend into said second tubular cylinder;

a spiral groove on the interior of said second tubular cylinder and extending over a substantial portion of the length of said second tubular cylinder;

at least one projection on the exterior of said first tubular cylinder and positionable to extend into said spiral groove, whereby when one said tubular cylinder is rotated relative to the other said tubular cylinder, said projection moves along said spiral groove to adjust the total combined length of said first and second tubular cylinders and the height of the drain inlet; and openings through the walls of said first and second tubular cylinders.

2. The assembly of claim 1, including a plurality of said projections spaced from each other around the circumference of said first tubular cylinder.

3. The assembly of claim 2, wherein said projections are spaced from each other over a substantial portion of the length of said first tubular cylinder.

4. The assembly of claim 1, wherein the openings through the wall of said second tubular cylinder are slots between flights of said spiral groove.

5. The assembly of claim 1, including said drain inlet attached to said first end of said second tubular cylinder.

6. An adjustable coupling assembly for adjustably spanning the distance between spaced but adjacent ends of two fluid conveying conduits, the assembly comprising:

a first elongate tubular cylinder having a first end which is constructed to extend into the end of one of the conduits;

a second elongate tubular cylinder having a first end which is constructed to extend into the end of the other conduit;

said first tubular cylinder having an end which is constructed to extend into the said second tubular cylinder;

a spiral groove on the interior of said second tubular cylinder and extending over a substantial portion of the length of said second tubular cylinder;

at least one projection on the exterior of said first tubular cylinder and positionable to extend into said spiral groove, whereby when one said tubular cylinder is rotated relative to the other said tubular cylinder, said projection moves along said spiral groove to adjust the total combined length of said first and second tubular cylinders; and in which at least one of said tubular cylinders comprises two portions which are semicircular in cross section, and said two portions are attached together to from said tubular cylinder.

7. The assembly of claim 6, including a plurality of said projections spaced from each other around the circumference of said first tubular cylinder.

8. The assembly of claim 7, wherein said projections are spaced from each other over a substantial portion of the length of said first tubular cylinder.

9. An adjustable coupling assembly for adjusting the height of a drain inlet for draining a fluid from an area, the assembly comprising:

a first tubular cylinder having a first end which is constructed to be attached to the inlet of a drain tile;

a second tubular cylinder having a first end which is constructed to be attached to the discharge of the drain inlet;

one said tubular cylinder having an end which is constructed to extend into the other said tubular cylinder;

a spiral groove on one tubular cylinder and extending over a substantial portion of the length of said tubular cylinder;

at least one projection on the other tubular cylinder and positionable to extend into said spiral groove, whereby when one said tubular cylinder is rotated relative to the other said tubular cylinder, said projection moves along said spiral groove to adjust the total combined length of said first and second tubular cylinders and the height of the drain inlet; and openings through the walls of said first and second tubular cylinders.

10. An adjustable coupling assembly for adjusting the height of a drain inlet for draining a fluid from an area, the assembly comprising:

a first tubular cylinder having a first end which is constructed to be attached to the inlet of a drain tile;

a second tubular cylinder having a first end which is constructed to be attached to the discharge of the drain inlet;

one said tubular cylinder having an end which is constructed to extend into the other said tubular cylinder;

a spiral groove on one tubular cylinder and extending over a substantial portion of the length of said tubular cylinder; and at least one projection on the other tubular cylinder and positionable to extend into said spiral groove, whereby when one said tubular cylinder is rotated relative to the other said tubular cylinder, said projection moves along said spiral groove to adjust the total combined length of said first and second tubular cylinders and the height of the drain inlet; and wherein at least one of said tubular cylinders comprises two portions which are semicircular in cross section, and said two portions are attached together to form said tubular cylinder.

11. An adjustable coupling assembly for adjusting the height of a drain inlet for draining a fluid from an area, the assembly comprising:

a first elongate tubular cylinder having a first end which is constructed to be attached to the inlet of a drain tile;

a second elongate tubular cylinder having a first end which is constructed to be attached to the discharge of the drain inlet;

said first tubular cylinder having an end which is constructed to extend into said second tubular cylinder;

a spiral groove on the interior of said second tubular cylinder and extending over a substantial portion of the length of said second tubular cylinder;

at least one projection on the exterior of said first tubular cylinder and positionable to extend into said spiral groove, whereby when one said tubular cylinder is rotated relative to the other said tubular cylinder, said projection moves along said spiral groove to adjust the total combined length of said first and second tubular cylinders and the height of the drain inlet; and in which at least one of said tubular cylinders comprises two portions which are semicircular in cross section, and said two portions are attached together to form said tubular cylinder.

12. The assembly of claim 11, wherein each of said portions includes fasteners along their longitudinal edges, and in which the fasteners on one portion attach to the fasteners on the other portion to attach the portions together to form said tubular cylinder.

13. The assembly of claim 12, wherein the fasteners along one longitudinal edge of a portion are projecting tabs and the fasteners along the other longitudinal edge are grooves, and wherein the tabs of one of said portions frictionally engage into the grooves of the other portion to attach the portions together.

14. The assembly of claim 13, wherein both of said tubular cylinders each comprise two portions.

15. The assembly of claim 11, wherein both of said tubular cylinders each comprise two portions.

16. An adjustable coupling assembly for adjusting the height of a drain inlet for draining a fluid from an area, the assembly comprising:

a first elongate tubular cylinder having a first end which is constructed to be attached to the inlet of a drain tile;

a second elongate tubular cylinder having a first end which is constructed to be attached to the discharge of the drain inlet;

said first tubular cylinder having an end which is constructed to extend into said second tubular cylinder;

a spiral groove on the interior of said second tubular cylinder and extending over a substantial portion of the length of said second tubular cylinder;

at least one projection on the exterior of said first tubular cylinder and positionable to extend into said spiral groove, whereby when one said tubular cylinder is rotated relative to the other said tubular cylinder, said projection moves along said spiral groove to adjust the total combined length of said first and second tubular cylinders and the height of the drain inlet; and a plurality of said projections spaced from each other around the circumference of said first tubular cylinder; openings through the walls of said first and second tubular cylinders; and wherein said openings through the wall of said second tubular cylinder are slots between flights of said spiral groove.

17. The assembly of claim 16, in which at least one of said tubular cylinders comprises two portions which are semicircular in cross section, and said two portions are attached together to form said tubular cylinder; wherein each of said portions includes fasteners along their longitudinal edges in which the fasteners on one portion attach to the fasteners on the other portion to attach the portions together to form said tubular cylinder; wherein the fasteners along one longitudinal edge of a portion are projecting tabs and the fasteners along the other longitudinal edge are grooves, and the tabs of one of said portions frictionally engage into the grooves of the other portion to attach the portions together.

18. The assembly of claim 17, wherein each of said tubular cylinders comprises said two portions.

19. The assembly of claim 17, including said drain inlet attached to said first end of said second tubular cylinder.

* * * * *